United States Patent [19]

Destefani et al.

[11] Patent Number: 4,974,900

[45] Date of Patent: Dec. 4, 1990

[54] VEHICLE SUPERSTRUCTURE, IN PARTICULAR FOR RAILWAY CARRIAGES FOR PASSENGER TRANSPORT

[75] Inventors: Giorgio Destefani; Antal Ritzl, both of Zürich, Switzerland

[73] Assignee: Swiss Aluminium Ltd., Chippis, Switzerland

[21] Appl. No.: 920,252

[22] Filed: Oct. 16, 1986

Related U.S. Application Data

[63] Continuation of Ser. No. 677,604, Dec. 3, 1984, abandoned.

[30] Foreign Application Priority Data

Dec. 23, 1983 [CH] Switzerland ..... 6893/83
Jun. 5, 1984 [CH] Switzerland ..... 2723/84

[51] Int. Cl.[5] ..... B62D 25/02

[52] U.S. Cl. ..... 296/187; 296/191; 105/397; 105/401; 52/45; 52/520; 411/903

[58] Field of Search ..... 296/178, 181, 183, 191, 296/187; 105/401, 397; 52/520, 404, 45; 411/903

[56] References Cited

U.S. PATENT DOCUMENTS

| | | | |
|---|---|---|---|
| 1,089,555 | 3/1914 | Hawksworth | 52/49 |
| 2,150,130 | 3/1939 | Ragsdale et al. | 105/401 |
| 2,245,611 | 6/1941 | Schultz | 105/401 |
| 2,287,400 | 6/1942 | Wells, Jr. | 105/401 |
| 2,294,357 | 8/1942 | Dean et al. | 105/397 |
| 2,476,451 | 7/1949 | Murphy et al. | 105/401 |
| 2,480,321 | 8/1949 | Clarke | 105/401 |
| 2,565,678 | 8/1951 | Dean | 105/397 |
| 2,615,115 | 10/1952 | Watter | 105/329 R |
| 2,680,503 | 6/1954 | Clarke | 105/401 |
| 3,353,863 | 11/1967 | Koot | 296/187 |
| 3,672,309 | 6/1972 | Van der Sluys et al. | 105/401 |
| 4,230,361 | 10/1980 | Nachbur et al. | 296/193 |
| 4,283,086 | 8/1981 | Morin | 296/178 |
| 4,425,001 | 1/1984 | Mauri | 296/178 |
| 4,490,083 | 12/1984 | Rebish | 411/338 |
| 4,542,933 | 9/1985 | Bischoff | 296/164 |

FOREIGN PATENT DOCUMENTS

| | | | |
|---|---|---|---|
| 1082613 | 6/1960 | Fed. Rep. of Germany | 105/401 |
| 1264484 | 3/1968 | Fed. Rep. of Germany . | |
| 2729910 | 1/1978 | Fed. Rep. of Germany . | |
| 2751753 | 5/1979 | Fed. Rep. of Germany . | |
| 3019843 | 12/1980 | Fed. Rep. of Germany . | |
| 1163667 | 9/1958 | France . | |
| 105777 | 5/1974 | German Democratic Rep. . | |
| 338484 | 7/1959 | Switzerland . | |
| 524496 | 8/1972 | Switzerland . | |

OTHER PUBLICATIONS

Automotive Industries, Jul. 28, 1928, pp. 128, 129.

*Primary Examiner*—Dennis H. Pedder
*Attorney, Agent, or Firm*—Bachman & LaPointe

[57] ABSTRACT

A vehicle superstructure, in particular for railway carriages to transport passengers, features a structural frame formed by side and end walls and roof. This forms an outer structural plane for the carriage superstructure which is covered by an outer skin and roof cover; insulating material is fitted between the structural plane and the outer skin and roof cover. The outer skin panels are on the one hand loosely mounted via spacers hooked into grooves in sections permanently attached to the carriage frame or outer structural plane, on the other hand releasably attached via other spacers to the structural plane or held by holders secured to sections of the carriage frame with interleaving insulation.

14 Claims, 5 Drawing Sheets

VEHICLE SUPERSTRUCTURE, IN PARTICULAR FOR RAILWAY CARRIAGES FOR PASSENGER TRANSPORT

This is a Continuation, of application Ser. No. 677,604 filed Dec. 3, 1984, abandoned.

BACKGROUND OF THE INVENTION

The invention relates to a vehicle superstructure, in particular for railway carriages for passenger transport, comprising floor, side and end walls and a roof, such that the sidewalls, end walls and roof form a structural frame.

Usually vehicle superstructures are made up of sheet and extruded aluminum or steel sections which amongst other things also determine the outer contour of the carriage. On the other hand insulation, which is usually necessary to equilibrate temperature fluctuations, is subsequently mounted on to the sections inside the carriage. With such a carriage the structural frame remains visible from outside, which means that the outer surface must be straightened and the weld seams dressed. These measures which are applied to the outer surface of the carriage to satisfy visual appearance requirements are usually very labor intensive and result in higher manufacturing costs.

As the extruded aluminum or steel sections at the same time form the load-bearing structure of the whole vehicle superstructure, this is directly damaged if a collision or other impact occurs, and requires careful repair. These repairs must, of course, be of such a standard that a satisfactory appearance is again obtained.

Furthermore, very often the insulation in the interior of the carriage has to be broken open as the extrusions on the outside serve at the same time for securing interior fittings such as, for example, seals, ash trays, fold-away tables or the like. This introduces the risk of creating at these places thermal bridges i.e. cold spots which can be eliminated only by means of difficult insulation measures.

The object of the invention is therefore to develop a carriage superstructure of the above mentioned kind but in which the described disadvantages do not arise. In particular the weight of the carriage superstructure should be as little as possible but its insulation towards the exterior especially effective. Particular value is also placed on simple assembly of the whole superstructure.

SUMMARY OF THE INVENTION

This object is achieved by way of the invention in that the sides and top of the carriage frame form an outer structural plane for the carriage superstructure which is covered over by an outer skin and roof cover, such that insulating material is provided between the outer structural plane and the outer skin and roof cover; and the outer skin is interrupted in the region of window and door openings.

Such an arrangement offers the advantage that the vehicle superstructure can be provided with insulation independent of interior fittings which can be installed later, and the insulation does not therefore have to be subsequently broken open. This means that cold spots (thermal bridges) are avoided If frequent, slight damage occurs, then with this arrangement the actual load bearing structure does not suffer as a result, but simply the insulation and the protective skin covering it.

This protective, outer skin on the superstructure can be of aluminum or steel sheet or any kind of composite. It should however preferably be made up of individual panels of an aluminum plastic composite material and is interrupted only in the region of openings for windows or doors. If a minor accident occurs, then only the panels of the outer skin which are affected need be removed and replaced by new ones. Furthermore, the design of the whole carriage superstructure can be very favorably influenced by the choice of the material for this purpose. A common material such as glass wool, for example, can be chosen for the insulation. Another possibility however is a more rigid material which can withstand slight impact from outside.

Should a fire occur, then passenger safety is greater as the whole of the insulating material is outside the passenger space.

To facilitate easier assembly and also replacement when damaged, the outer skin panels should be mounted on the one hand loosely via spacers engaging in grooves in a section attached to the superstructure frame, on the other hand releasably via other spacers which are attached to sections making up the carriage superstructure or the structural plane. Each of the spacers is secured to the outer skin. Those spacers which have a loose connection to sections making up the structural plane are C-shaped in the exemplified embodiment presented here, and are hooked in to the corresponding groove by means of a flange. The other spacers which provide the releasable connection are in the form of an S-shaped section which is braced against the outer plate at one end and makes the releasable connection with the section at the other end. For this purpose the section permanently attached to the structural plane features a clamping piece which clamps on to a plastic sleeve surrounding a metal sleeve with internal thread. A bolt which also passes through the spacer can then be inserted into this metal sleeve. This section has preferably projecting out from it a further part which forms the groove to accommodate the spacer of the next outer panel.

If the window, door and floor regions are disregarded for the present, then the assembly of the outer skin is performed in a simple manner. After the carriage frame, usually out of hollow or solid sections, has been assembled, an upper longitudinal beam is employed to provide the junction between the sidewall and the roof. A gutter section for rain water is attached to this longitudinal beam. Below the actual gutter this section features a groove to accommodate a loose spacer which is described above in greater detail. Sections to secure the releasable spacers are mounted horizontally over the whole of the sidewall at the correct spacing apart from each other and running in the longitudinal direction; the sidewall is then fitted with the insulating material. For the covering of the insulation with the outer skin the first of these panels is hooked by means of its spacer into the groove in the gutter section. The loose form of fixture means that the outer skin panel is easier to mount, and that irregularities in the sidewall stemming from the carriage frame can be compensated. The outer skin panel is then placed against the structural plane bearing the horizontal section such that the releasable spacer is pushed against the clamping piece of that section where it is bolted securely in place. The next outer panel can then be hooked on to the groove on the part of the section below the clamping piece, the spacing here being chosen such that the lower panel lies behind the upper panel thus concealing the join between the releasable spacer and the section.

In order to fill out the space between two outer panels, rubber or plastic strips which join the two neighbouring panels and at the same time act as insulation are provided. As such this sealing strip is pushed onto the upper panel and clamps over a bent part of the lower panel.

This way an outer skin which is independent of the load bearing structure of the carriage is achieved; at the same time it satisfies the requirements regarding appearance, is easy to assemble and replace, and prevents cold spots i.e. thermal bridging.

Another form of junction between the outer skin panels and the carriage frame is chosen by preference for windows, door and floor regions. For this a channel-shaped section is provided as a holder, the said section being pushed onto the outer panel concerned while a piece projecting inwards from that section is bolted securely to the window or door frame or from below to the lower longitudinal beam. The channel-shaped section preferably features jagged teeth for better retention of the outer skin panel.

It is easy to see that the selected means of joining permits unhindered expansion of the outer skin such as may occur for example as a result of heating. The outer skin on the roof is, according to the invention, in the form of individual panels. The carriage frame in the region of the roof should be made up of extrusions or sheets which are connected to the upper longitudinal beams and, if necessary, are reinforced by spars or struts. Projecting out from the upper longitudinal beam and the roof sections are various supports or struts which hold the roof panels at a given distance from the carriage frame so that insulating material can be inserted in the space between. The roof panel inclined towards the upper longitudinal beam should feature at its outer part a strip which is bent down and is pushed into a slit in the gutter section similar to that in the holder described above. After this two neighboring roof panels are joined together via a hat-shaped section placed on top such that for example each sidewall of the said section rests on one of the roof panels spanning a part of the panel which is bent upwards. Two clamping pieces on the hat-shaped section extend down into the space between two roof panels and hold between them a plastic sleeve housing a metal sleeve. A bolt which can be passed from inside the carriage through a rail section joining two roof sections of the carriage frame can be inserted into the said metal sleeve. The rail section as such should feature a channel which accommodates the head of the bolt and prevents it from turning.

Furthermore, according to the invention the channel formed by the sides of the hat-shaped section and the clamping pieces is filled with an insulating material into which the bent parts of the roof panel are pushed.

A hat-shaped section thus mounted permits very easy assembly and exchange of roof panels. At the same time it allows the panels to expand under the influence of heat. The invention also provides for the hat-shaped section to feature a simple covering strip to hold the roof panels in place.

Provided in the wall towards the interior of the carriage are fresh air supply ducts and heating elements. The latter can in particular be situated in the roof which, when outside temperatures are low, can create a feeling of well-being.

The sections in the carriage frame should preferably be reinforced by struts which are inclined at an angle to a section wall. This improves the shear resistance.

BRIEF DESCRIPTION OF THE DRAWINGS

Further advantages, features and details of the invention are revealed in the following description of preferred exemplified embodiments and with the aid of the drawings viz.

DETAILED DESCRIPTION

Figure 1:
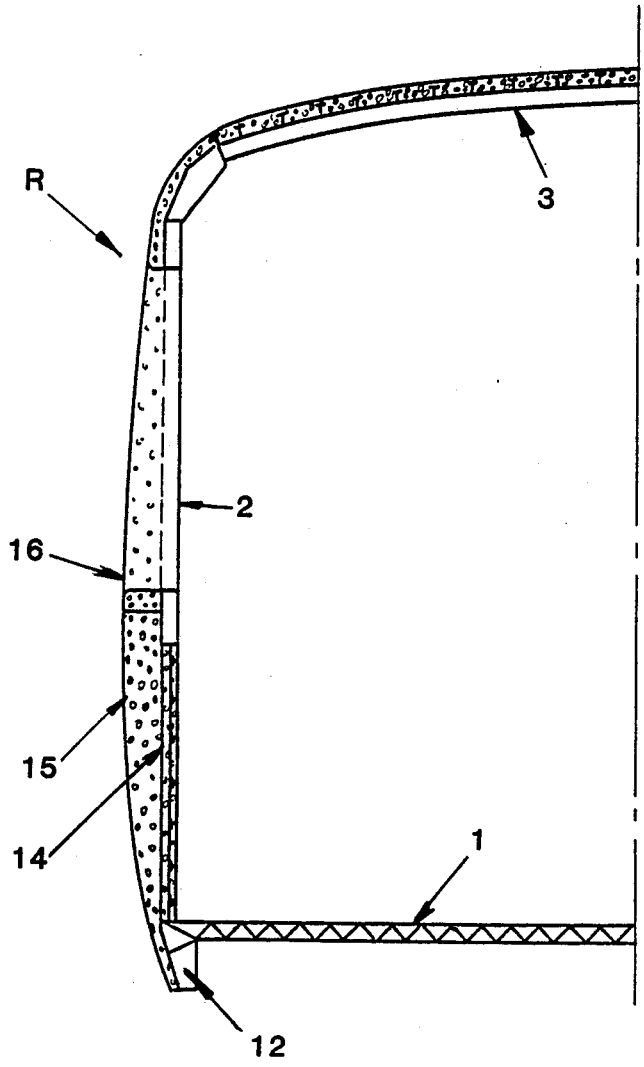
FIG. 1: A schematic representation of a transverse cross section through half of a carriage superstructure.
Figure 3:
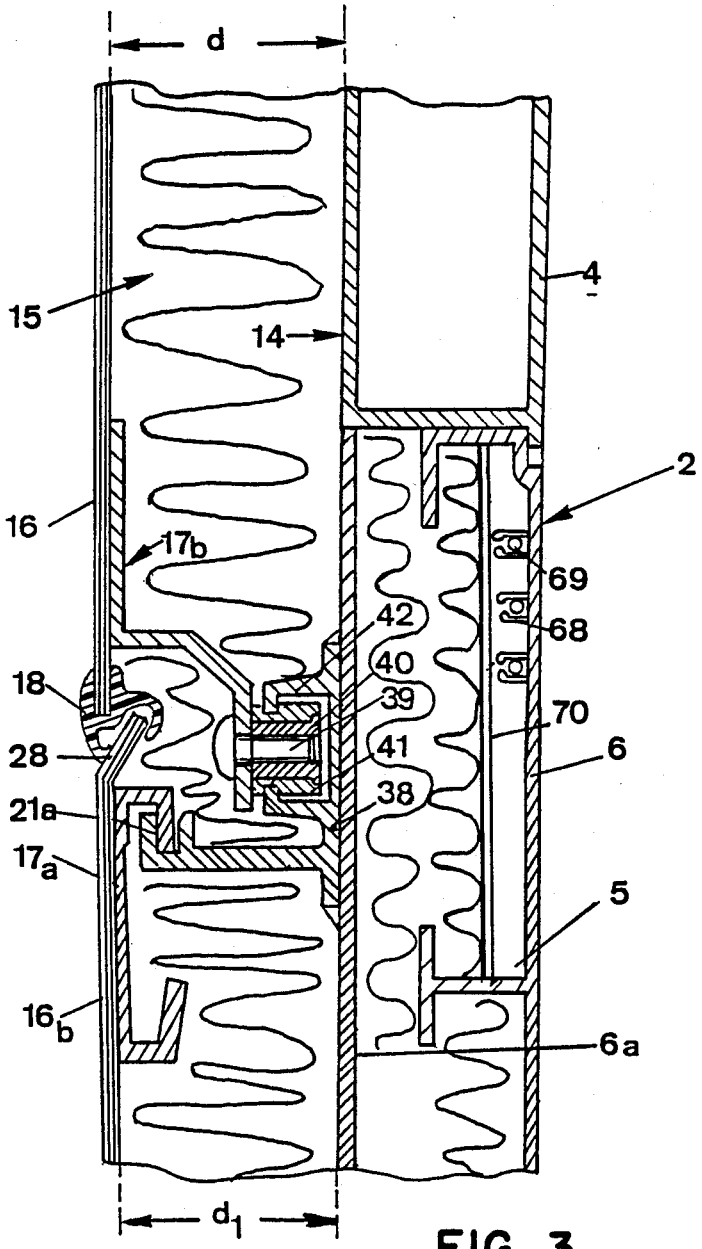
FIG. 3: An enlarged transverse cross section of part of the carriage sidewall.
Figure 4:
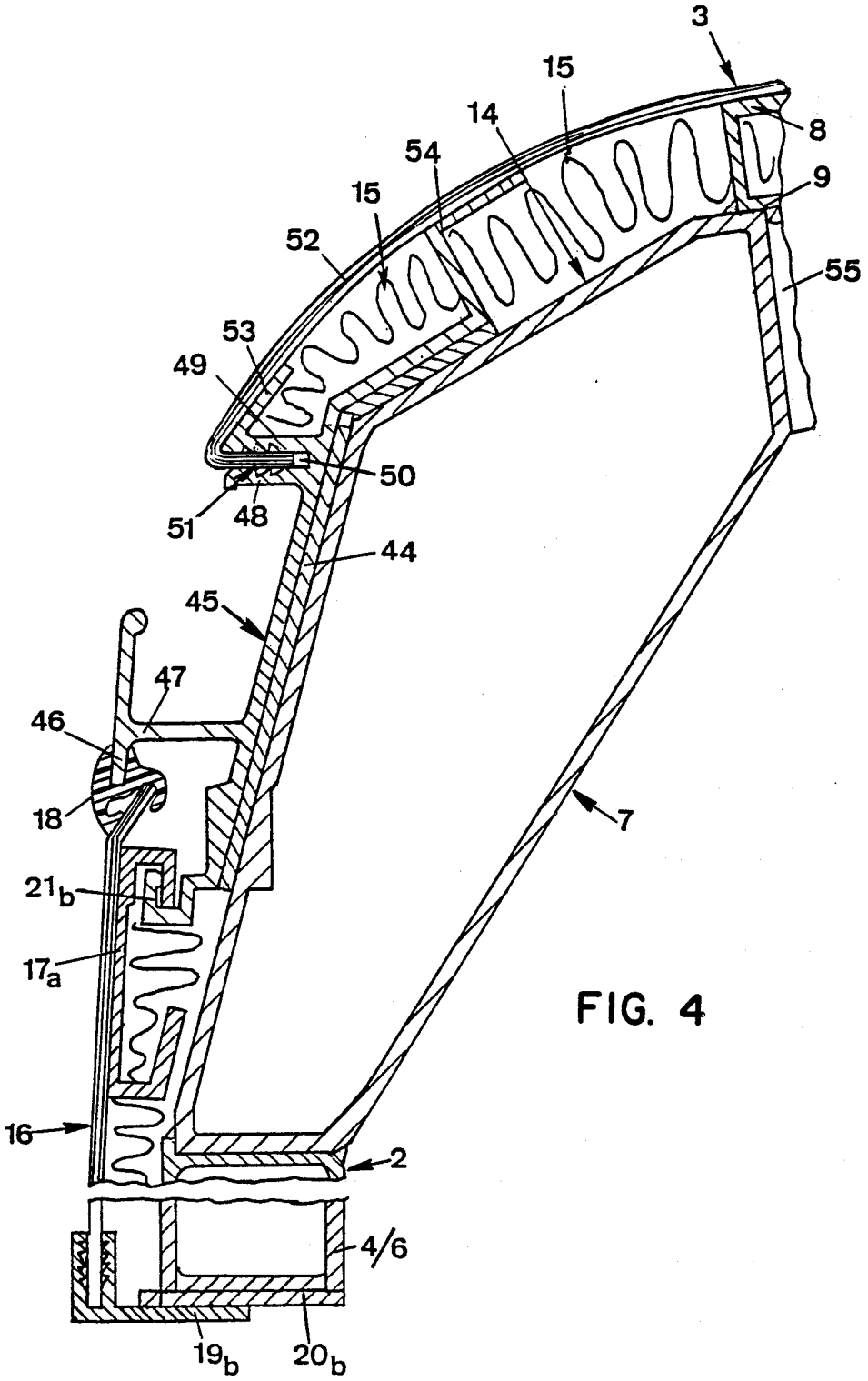
FIG. 4: An enlarged transverse cross section of part of the region where the carriage sidewall meets the roof cover.
Figure 7:
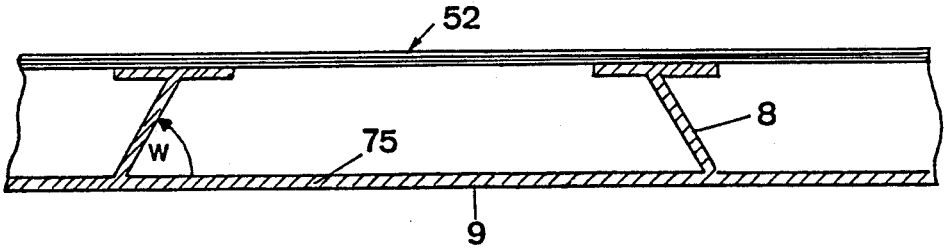
FIG. 7: An enlarged transverse cross section through a part of a carriage superstructure.

A carriage superstructure R is, as shown in FIG. 1, made up essentially of a floor 1, sidewalls 2, roof 3, and endwalls which are not shown here. The walls and the roof 3 are as such made up of sections which are partly different in shape and/or sheets which together form the carriage frame. For example, as shown in figure 3, hollow sections 4 for fresh air supply and sections 6 reinforced by struts 5 are provided for sidewalls 2, while, as shown in FIG. 4, a hollow section forming an upper longitudinal beam 7 forms the junction with the solid section 9 featuring support struts 8. Preferably the support struts 8 and also, if desired, struts 5 form an angle w with a section wall 75, such as is shown simply by way of example in FIG. 7. The floor 1 on the other hand is made up of a floor plate or board 11 which has a covering 10 on it and, as shown in FIG. 2, is supported at the sides by a lower longitudinal section 12.

Within the carriage frame is an outer and structural frame 14 which is made up of individual sections, is fitted with insulating material 15 and is enclosed as a whole by an outer skin 16. The insulating material 15 and the outer skin 16 are interrupted only in the region of window and door openings which are not shown here. This outer skin 16 comprises steel or aluminum sheet, preferably however individual aluminum-plastic composite panels. These are held at a predetermined distance from the structural plane 14 by spacers 17 and support struts 8. They are joined together via plastic strips 18 and to the superstructure via clamps **19*a,b* which are attached to the superstructure with an insulating strip 20*a,b* between the clamp 19*a,b*** and the superstructure.

Figure 2:
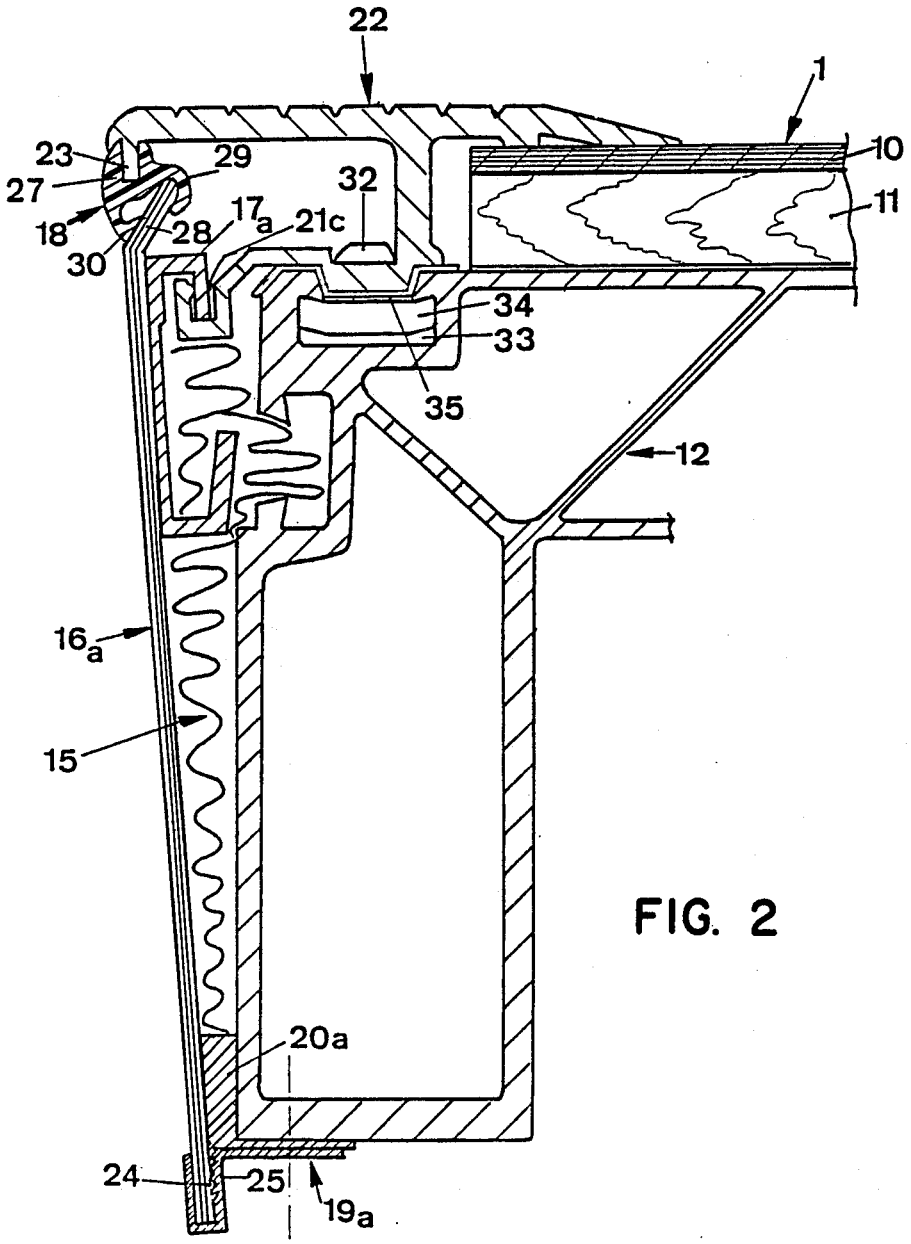
FIG. 2: An enlarged transverse cross section through a detail in the region of a step for entering the carriage.

A simple version of a spacer **17*a*, as shown in FIG. 2, comprises a C-shaped extrusion which is hooked loosely into a groove 21*c* in part of the superstructure, in this case a tread-plate section 22. The loose attachment of spacer 17*a* enables, on assembly, the outer skin panel 16*a* on the one hand to be secured via plastic strip 18 to a nose 23 on the tread-plate section 22, on the other hand permits it to be pushed into clamping piece 19*a* which is in the form of a groove-shaped section 25** with engaging teeth 24 inside the groove. This clamping piece 19*a* can be swung under the lower longitudinal beam 12 and secured to this after an interleaving strip of insulation 20 is inserted. Plastic section 18 features a channel 27 to accommodate the nose 23 of the tread-plate section 22 and a hook-like strip 29 which engages on a bent-over strip 28 of the outer panel 16*a* and is braced against this strip 28 by means of its foot 30. The tread-plate section 22 is in turn connected to the lower longitudinal beam 12 via bolt 32 and a clamping piece 34 which, with interleaving strip of insulation 35, engages in an undercut groove 33 in the lower longitudinal beam 12.

In the region of the sidewalls 2, as shown in FIG. 3, it can be necessary to employ different types of spacers 17 to keep the outer skin panel 16 at the required distance $d,d_1$ from the frame wall 14 which is made up of sections 4 and 6. Thus the C-shaped holder/spacer means 17*a*, described in detail above, is adhesively fixed to the outer panel 16*b* close to the bent-over strip 28. In order to provide a loose connection, this time it engages in a groove 21*a* which is part of a section 38 welded on to the frame wall 14. The upper portion of outer skin panel 16*b* is secured in place by a spacer which is designated 17*a*, outer skin panel 16 is held in place by a spacer which is designated 17*b*. Thus, the outer skin panels 16 have on their upper side a C-shaped spacer 17*a* and on their lower side an S-shaped spacer 17*b*. The spacer 17*b* is a crooked, S-shaped extrusion which is attached at one end to the outer panel 16. Passing through the other end is a bolt 39 which engages in a metal sleeve 40 which in turn is accommodated in a plastic sleeve 41 for insulation purposes. A clamp 42 which is part of section 38 engages on this plastic sleeve 41. The outer panels 16*a* and 16*b* are joined via another rubber or plastic strip 18. The assembly of the carriage superstructure R in the region of the sidewalls is as a result simplified to a very high degree. After the carriage frame has been made up out of sections 4 and 6, section 38 is welded on to the outer sidewall 14 and the layer of insulation 15 applied. Then the uppermost outer skin panel 16 can be hooked on to groove 21 via spacer 17*a* and secured to the next, lower section 38 by means of spacer 17*b*. The plastic strip 18 is fitted on and the next outer skin panel 16 hooked into groove 21 and secured to the next lower section 38 by spacer 17*b*. The whole outer skin for the sidewalls 2 is thus formed in this simple manner.

The junction between the sidewall 2 and the roof 3 is, as shown in FIG. 4, achieved by the upper longitudinal beam 7, which is made of a section which, with interleaving layer of insulation 44, features a gutter section 45 for rain water. Towards the bottom end the gutter section 45 features a channel 21*b* into which the above described spacer 17*a* engages supporting the outer panel 16. The panel 16 itself is joined via the plastic strip 18 to a section part 46 joining up with the actual gutter 47.

Above the gutter 47 the gutter section 45 features two outward projecting strips 48 and 49 which form a slit 50 with jagged teeth 51 inside that engage a bent-over part of a roof cover panel 52. This roof panel 52 is held at a distance from the upper longitudinal beam 7 by a wing 53 on an upper extrusion part 49 and by a supporting strip 54 also on the gutter section 45, such that the insulating material is held in place. The roof panel 52 also passes over extrusion 9 and supporting strut 8 which projects out from it, not shown fully in FIG. 4, and is, if desired, supported from below by roof spar 55.

Figure 5:
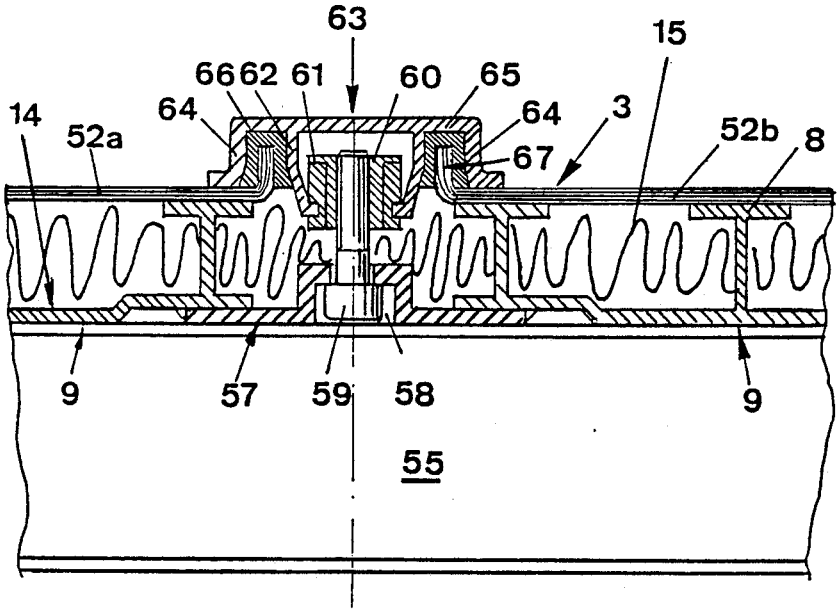
FIG. 5: An enlarged transverse cross section through a part of the roof cover of the carriage.

FIG. 5 illustrates the manner of connecting individual roof panels 52*a* and 52*b* and the attachment of these to the roof section 9. Two roof sections 9 are welded onto the same rail 57 running between them and inserted from the carriage interior. This rail features a channel 58 to accommodate a bolt 59 which passes through a metal sleeve 60 enclosed in turn in a plastic, insulating sleeve 61. Clamping pieces 62 which are part of a hat-shaped section 63 engage firmly with the plastic sleeve 61. Each of the flanges 64 of section 63 rests on a roof panel 52*a* and 52*b*. The flanges 64 and clamping pieces 62 form between them a channel 65 which is filled with insulating material 66 into which extends a part 67 of roof panel 52*a* and 52*b* and between the struts 8; it is possible also for the supporting struts 8 themselves to be covered with insulation on the side facing the roof panels 52*a*, 52*b*.

Figure 6:
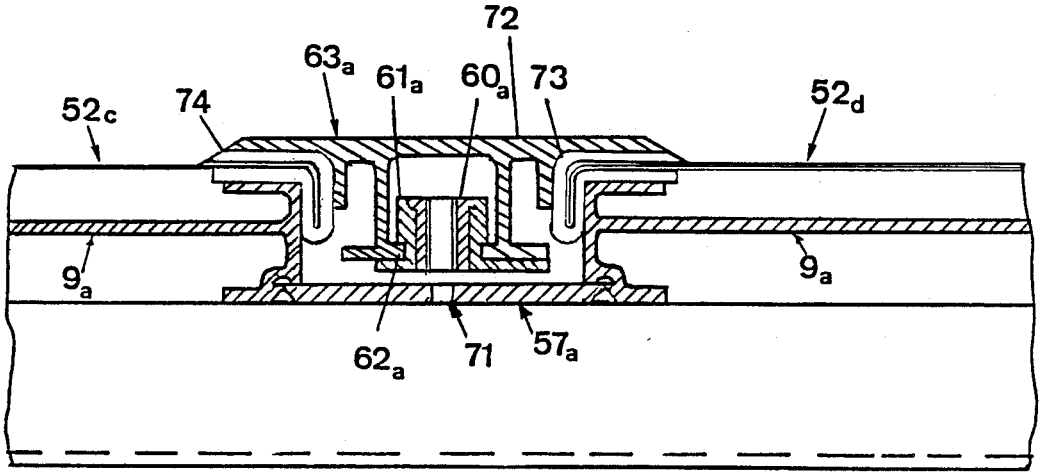
FIG. 6: An enlarged transverse cross section through a part of the roof cover of the carriage in a different form from that shown in FIG. 5.

FIG. 6 shows another version for connecting individual roof panels 52*c* and 52*d* and for fixing these to roof sections 9*a*. Two roof sections are welded together via a common rail 57*a* on the interior side of the carriage. This rail 57*a* features a hole 71 to accommodate a bolt, which is not shown here. This bolt passes through a metal sleeve 60*a* which is surrounded by an insulating plastic sleeve 61*a*, which clamping pieces 62*a* of a hat-shaped section 63*a* firmly engage on. This section 63*a* includes covering strips 72 over the roof panels 52*c* and 52*d* which are engaged by an offset clamp 73 of section 9*a*. A strip of insulation 74 is inserted on the one hand between the clamping pieces 73 and the section 9*a* and on the other hand between the clamping pieces 73 and the covering strip 72.

As shown in FIG. 3, hollow sections 4 situated between the outer structural plane 14 and the interior of the carriage serve as fresh air supply ducts, especially in the region of windows. Connected to these are vertical posts 6*a* and solid section 6, which are likewise filled with insulating material 15. Solid sections 6 accommodate heating elements 69 which are supported by clamps 68; the said heating elements are covered by an aluminum foil 70.

What is claimed is:

1. Vehicle superstructure including an inner structural frame, an outer side skin and outer roof skin covering the inner structural frame wherein the outer side skin and outer roof skin are each made up of individual panels selected from the group consisting of aluminum sheet and steel sheet, insulating material between the outer side skin and outer roof skin coverings and the inner structural frame, spacers separating the outer side skin from the inner structural frame and releasably attaching the outer side skin to the structural frame and connecting means for receiving portions of adjacent ones of said outer skin panels and for releasably engaging said adjacent panel portions.

2. Vehicle superstructure according to claim 1 wherein said connecting means includes a clamping strip and channel means and wherein a first of said adjacent outer skin panels includes a bent-over strip engaged by said clamping strip and a second of said adjacent outer skin panels has an end portion engaged by said channel means.

3. Vehicle superstructure according to claim 2 wherein said connecting means is selected from the group consisting of rubber and plastic.

4. Vehicle structure according to claim 1 further comprising at least one section permanently attached to the structural frame, said separating spacers including a first spacer having a hook-shaped portion attached to each said side skin panel; and each said permanently attached section having a groove for receiving said hook-shaped spacer portion of a respective first spacer and loosely mounting one of said outer side skin panels therein.

5. Vehicle structure according to claim 1 including holders secured to the structural frame, interleaving insulation intermediate said holders and the frame, and said holders each having jagged teeth in a groove-like section which accepts the outer side skin covering.

6. Vehicle structure according to claim 4 wherein a plurality of sections are permanently attached to the structural frame, said spacers including a second spacer fixed to at least some of said outer side skin panels, each said second spacer comprising an S-shaped section braced at one end against the outer side skin panel and releasably connected to one of said permanently attached sections.

7. Vehicle superstructure according to claim 6 wherein each said permanently attached section has a clamping piece which holds a plastic sleeve that encloses a metal sleeve to accommodate a bolt that passes through a portion of an S-shaped spacer fixed to a first of said outer side skin panels and a part which projects outwardly and includes said hook-shaped spacer portion receiving groove for loosely mounting therein a second of said outer side skin panels adjacent to said first outer side skin panel.

8. Vehicle superstructure according to claim 6 including a gutter section attached to the structural frame having a groove therein, an uppermost outer side skin panel, said first spacer attached to the uppermost panel comprising a C-shaped spacer, a portion of said C-shaped spacer hooked into said groove in the gutter section, said uppermost outer side skin panel having one of said second spacers attached thereto and engaging one of said permanently attached sections via said one second spacer, and an adjacent side panel being hooked into grooves of said one section permanently attached to the structural frame engaged by said one second spacer.

9. Vehicle structure according to claim 1 including a tread-plate section having a groove therein and a lower outer side skin panel engaged at a first end to said tread-plate section via one of said spacers and engaged at a second end to a holder attached to the bottom of a lower longitudinal beam, and said one spacer being positioned within the groove in said tread-plate section and said second end being fitted into said holder.

10. Vehicle superstructure according to claim 1 wherein the structure frame includes an upper longitudinal beam and a plurality of extensions, the outer roof skin is held in place by section parts, supporting strips and struts and insulating material is fitted between the outer roof skin and the frame.

11. Vehicle superstructure according to claim 10 including a gutter section, a bent-over part of the outer roof skin engaging a slit which is formed by two projections on the gutter section, said projections including jagged teeth, and neighboring outer roof skin panels being joined by a hat-shaped section set on top thereof at a junction between said panels.

12. Vehicle superstructure according to claim 11 wherein the hat-shaped section includes sides and clamping pieces, each side rests on a different outer roof skin panel, said sides and said clamping pieces form channels for accommodating upwardly projecting portions of said outer roof skin panels, said clamping pieces extend into a space between said outer roof skin panels and engage a plastic sleeve housing a metal sleeve into which projects a bolt from the carriage interior and said bolt passes through a rail joining two roof sections.

13. Vehicle superstructure according to claim 12 wherein said channels accommodating said upwardly projecting panel portions are each filled with a plastic material.

14. Vehicle superstructure according to claim 11 wherein the hat-shaped section includes a covering strip over part of two neighboring outer roof skin panels and a clamping piece engaging a plastic sleeve housing a metal sleeve into which projects a bolt secured to a rail joining two roof sections.

* * * * *

UNITED STATES PATENT AND TRADEMARK OFFICE

CERTIFICATE OF CORRECTION

PATENT NO. : 4,974,900

DATED : DECEMBER 4, 1990

INVENTOR(S) : GIORGIO DESTEFANI ET AL.

It is certified that error appears in the above-identified patent and that said Letters Patent is hereby corrected as shown below:

IN COLUMN 8, CLAIM 10, LINE 13, DELETE "EXTENSIONS" AND INSERT --EXTRUSIONS--.

Signed and Sealed this

Tenth Day of March, 1992

*Attest:*

HARRY F. MANBECK, JR.

*Attesting Officer*

*Commissioner of Patents and Trademarks*